US007298999B2

(12) United States Patent
Yoshida

(10) Patent No.: US 7,298,999 B2
(45) Date of Patent: Nov. 20, 2007

(54) IMAGE FORMING APPARATUS PROVIDING AN IDEAL CONTACT PRESSURE OF A PRIMARY TRANSFER UNIT

(75) Inventor: Ken Yoshida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 11/265,174

(22) Filed: Nov. 3, 2005

(65) Prior Publication Data

US 2006/0099014 A1 May 11, 2006

(30) Foreign Application Priority Data

Nov. 11, 2004 (JP) ..... 2004-327210

(51) Int. Cl.
*G03G 15/01* (2006.01)
*G03G 15/16* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS 5,671,464 A * 9/1997 Kubota ..... 399/101
6,101,360 A * 8/2000 Hara et al. ..... 399/308
6,226,465 B1 * 5/2001 Funatani ..... 399/44
2004/0136760 A1 7/2004 Yoshida et al.
2004/0208678 A1 * 10/2004 Yoda et al. ..... 399/302
2005/0013636 A1 1/2005 Sawai et al.
2005/0089786 A1 * 4/2005 Sugiura et al. ..... 430/111.4
2005/0147424 A1 7/2005 Kato et al.

FOREIGN PATENT DOCUMENTS

JP 2000-162899 6/2000
JP 2001-235946 8/2001

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus includes an image carrier that carries a toner image formed of toner, a transfer belt, a primary transfer unit that transfers the toner image from the image carrier to the transfer belt, and a secondary transfer unit that transfers the toner image from the transfer belt to a recording medium. A contact pressure P of the primary transfer unit, a thickness T of the transfer belt, and an average roundness R of the toner satisfy expression 1, and the thickness T of the transfer belt satisfies expression 2, a Young's modulus of the transfer belt being 2,500 MPa or more and 5,000 MPa or less, $1.5T-40 \leqq P \leqq 1.5T+A$ expression 1

$40 \leqq T \leqq 200$ expression 2 where P is in g/cm$^2$, T is in μm, and A=2,000R−1,800.

4 Claims, 5 Drawing Sheets

| CONTACT PRESSURE (g/cm²) | BELT THICKNESS (μm) | | | | |
|---|---|---|---|---|---|
| | 40 | 60 | 80 | 100 | 200 |
| 10 | × | × | × | × | × |
| 20 | △ | × | × | × | × |
| 40 | ○ | × | × | × | × |
| 60 | ○ | △ | × | × | × |
| 80 | ○ | ○ | △ | × | × |
| 100 | ○ | ○ | ○ | × | × |
| 120 | ○ | ○ | ○ | △ | × |
| 140 | ○ | ○ | ○ | ○ | × |
| 160 | ○ | ○ | ○ | ○ | × |
| 180 | ○ | ○ | ○ | ○ | × |
| 200 | ○ | ○ | ○ | ○ | × |
| 260 | ○ | ○ | ○ | ○ | △ |
| 300 | ○ | ○ | ○ | ○ | ○ |

IMAGE FORMING APPARATUS PROVIDING AN IDEAL CONTACT PRESSURE OF A PRIMARY TRANSFER UNIT

CROSS-REFERENCE TO RELATED APPLICATIONS

The present document incorporates by reference the entire contents of Japanese priority document, 2004-327210 filed in Japan on Nov. 11, 2004.

BACKGROUND OF THE INVENTION

1. Field of the Invention

The present invention relates to an electrophotographic image forming apparatus.

2. Description of the Related Art

Conventional image forming apparatuses that use an intermediate transfer method are well known. Such an image forming apparatus includes an image carrier, an intermediate transfer member, a primary transfer unit that transfers a toner image from the image carrier to the intermediate transfer member (primary transfer), and a secondary transfer unit that transfers the toner image from the intermediate transfer member to a transfer sheet (secondary transfer). A photoconductor is typically used as the image carrier for carrying a toner image according to image data. The intermediate transfer member is an endless belt wound over a plurality of rollers. An electric field is required both in the primary transfer unit and the secondary transfer unit to effect the primary transfer and the secondary transfer, respectively. The primary transfer unit and the secondary transfer unit must accurately, reliably and efficiently transfer the toner image.

To reliably perform the primary transfer, it is imperative to maintain a contact pressure between the photoconductor and the intermediate transfer belt within a certain range. If the contact pressure is too low, even transfer cannot be attained, i.e., the resultant toner image has an uneven density. If the contact pressure is too high, a hollow portion (particularly in lines and characters) appears in the resultant toner image (hereinafter, "hollow defect"). To remedy this problem, Japanese Patent Laid-Open Publication No. 2000-162899 and Japanese Patent Laid-Open Publication No. 2001-235946 disclose a technology for controlling the contact pressure range between the photoconductor and the intermediate transfer belt.

However, the ideal contact pressure range for realizing reliable transfer varies according to the thickness of the intermediate transfer belt and the average roundness of the toner particles. Thus, reliable transfer cannot always be attained with the same contact pressure range.

SUMMARY OF THE INVENTION

It is an object of the present invention to at least solve the problems in the conventional technology.

According to an aspect of the present invention, an image forming apparatus includes at least one image carrier that carries a toner image formed of toner according to image data, a transfer belt that is stretched over a plurality of rollers and pressed against the image carrier, at least one primary transfer unit that transfers the toner image from the image carrier to the transfer belt, and a secondary transfer unit that transfers the toner image from the transfer belt to a recording medium, wherein a contact pressure P of the primary transfer unit, a thickness T of the transfer belt, and an average roundness R of the toner satisfy expression 1, and the thickness T of the transfer belt satisfies expression 2, a Young's modulus of the transfer belt being 2,500 MPa or more and 5,000 MPa or less, $$1.5T-40 \leqq P \leqq 1.5T+A \qquad \text{expression 1}$$

$$40 \leqq T \leqq 200 \qquad \text{expression 2}$$

where P is expressed in a unit of g/cm$^2$, T is expressed in a unit of μm, and A=2,000R−1,800.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
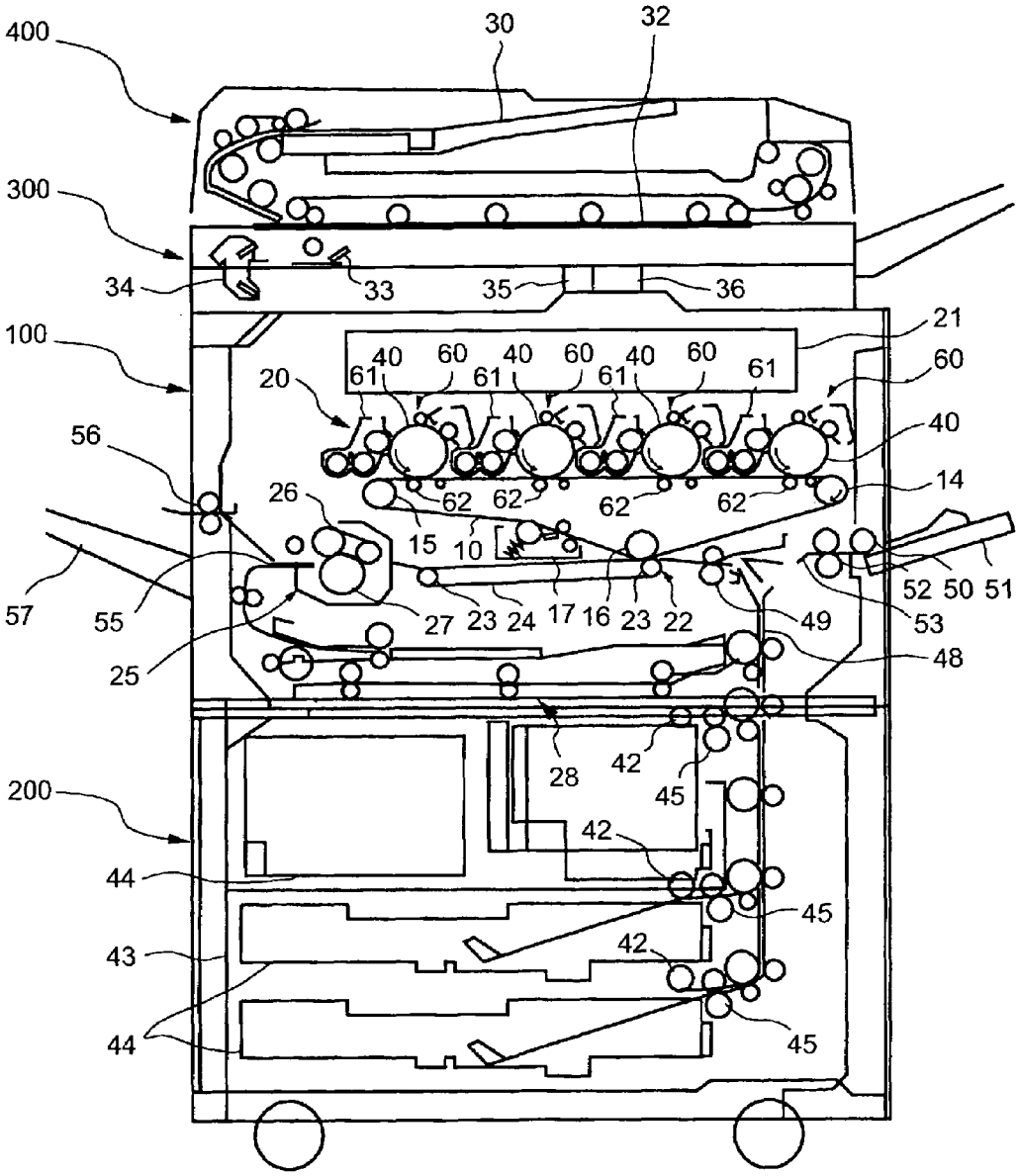
FIG. 1 is a drawing of an image forming apparatus according an embodiment of the present invention.

FIG. 1 is a drawing of an image forming apparatus according to an embodiment of the present invention. A color copier is presented as an example of the image forming apparatus. The color copier is a tandem-type electrophotographic copier that includes an intermediate transfer belt 10. The bottom portion of the color copier is a paper feeding table 200 and a main unit 100 is arranged above the paper feeding table 200. A scanner 300 is stacked on the main unit 100. An automatic document feeder (ADF) 400 is provided on the scanner 300.

The mid portion of the main body 100 is provided with a transfer device 20 including the intermediate transfer belt 10. The intermediate transfer belt 10 is stretched over a driving roller 14 and subordinate rollers 15 and 16, and rotates clockwise. A belt cleaning device 17, situated to the left of the subordinate roller 15, cleans residual toner remaining on the intermediate transfer belt 10 after image transfer. The residual toner is recycled and used again by the transfer device 20 in the process of image formation.

The intermediate transfer belt 10 stretches straight across the driving roller 14 and the subordinate roller 15. Four drum-type photoconductors 40Y, 40C, 40M, and 40K are located above the intermediate transfer belt 10 in this order and along the direction of rotation of the intermediate transfer belt 10. The photoconductors 40Y, 40C, 40M, and 40K (hereinafter, "40", except where specified), respectively form yellow, cyan, magenta, and black images. Each of the photoconductors 40 turns counter-clockwise, and each has in its vicinity a charging device 60, a developing device 61, a primary transfer roller 62, a drum cleaning device, and a quenching device. An exposing device 21 is disposed above the photoconductor 40.

A secondary transfer device 22 is disposed below the intermediate transfer belt 10. The secondary transfer device 22 is pressed against the subordinate roller 16 through the intermediate transfer belt 10 disposed therebetween. The secondary transfer device 22 transfers at once the superposed toner images from the intermediate transfer belt 10 to a transfer sheet P conveyed by the intermediate transfer belt 10.

A fixing device 25 that fixes the toner image onto the transfer sheet P is disposed downstream of the secondary transfer device 22 in the sheet conveyance direction. The fixing device 25 includes an endless fixing belt 26 and a pressure roller 27, which is tightly pressed against the fixing belt 26. The transfer sheet P is conveyed to the fixing device 25 by an endless conveyor belt 24 stretched across two rollers 23. The secondary transfer device 22 can be a transfer device using a transfer roller and a non-contact charger. A sheet reversing device 28 is disposed below the secondary transfer device 22. The sheet reversing device 28 reverses the transfer sheet P bearing an image on one side.

When taking a color copy, an original is placed on a document dispenser 30 of the automatic document feeder 400. The original can be manually placed on a contact glass 32 of the scanner 300 after opening the automatic document feeder 400. The original is then pressed against the contact glass 32 by closing the automatic document feeder 400.

When a not shown switch is operated, the original placed on the automatic document feeder 400 is automatically carried to the contact glass 32. If the original is manually placed on the contact glass 32, operating the switch starts a first scanning member 33 and a second scanning member 34 of the scanner 300. A beam from a light source of the first scanning member 33 is exposed to the original. The light reflected from the original is directed by a mirror of the first scanning member 33 towards the second scanning member 34. This light hits a pair of mirrors of the second scanning member 34 and flips 180° upon hitting the mirrors. This reflected light then passes through an imaging lens 35 and enters a reading sensor that reads the contents of the original.

When the start switch is operated, the intermediate transfer belt 10 and the photoconductors 40Y, 40C, 40M, and 40K start turning. Yellow, cyan, magenta, and black images are respectively formed on the photoconductors 40Y, 40C, 40M, and 40K. The images of each color formed on the photoconductors 40 are superposed on the intermediate transfer belt 10 and form a full color image.

Meanwhile, a feeding roller 42 of a selected feeding section in the paper feeding table 200 turns and sheets P are rolled out from a selected feeding cassette 44 in a paper bank 43, separated into single sheets by a separating roller 45, and conveyed to a feeding channel 48. The sheet P comes in contact with a resist roller 49 and stops for a while. In the case of manual paper feeding, the sheets P placed in a manual tray 51 are rolled out by a rolling feeding roller 50, separated into single sheets by a separating roller 52, and conveyed to a manual feeding channel 53. The sheet P then stops upon contact with the resist roller 49.

In either case, the resist roller 49 starts turning in synchronization with the color image on the intermediate transfer belt 10 to convey the sheet P stopping against the resist roller 49, so that the color image is transferred to the sheet P by the secondary transfer device 22. The sheet P bearing the color image is conveyed by the secondary transfer device 22 to the fixing device 25. The fixing device 25 fixes the color image by applying heat and pressure. The sheet P bearing a fixed color image is guided towards an exit by a switching pawl 55, ejected by an ejection roller 56, and is stacked on a discharge tray 57.

If "both sides" mode is selected, the sheet P bearing the color image on one side is conveyed to the sheet reversing device 28 by the switching pawl 55. The sheet reversing device 28 reverses the sheet P and reintroduces the sheet P to the transfer position and allows the image to be formed on the reverse side. Once the image formation on the reverse side is completed, the sheet P is ejected to the discharge tray 57 by the ejection roller 56.

If a black monochrome image is to be formed on the intermediate transfer belt 10, only the subordinate rollers 15 and 16 are operated to disengage the photoconductors 40Y, 40C, and 40M, corresponding to yellow, cyan, and magenta images, respectively, from the intermediate transfer belt 10. In a single-drum type image forming apparatus, which has a single photoconductor instead of four, the speed of copying a color original is increased by first processing black and then the rest of the colors.

In such a structure, the resist roller 49 is normally earthed. However, a bias may also be impressed on the sheet P to remove paper particles. For example, if a bias is impressed with a conductive rubber roller having a diameter of 18 mm and a conductive nitrile-butadiene rubber (NBR) covering that is 1 mm thick, the volume resistivity of the rubber is around $10^9$ Ωcm, and a voltage of −800 V is impressed on the side onto which the toner is transferred (surface), and +200 V is impressed on the reverse side. Generally, in the image forming apparatus employing the intermediate transfer system, paper particles do not reach the photoconductor. Thus, the resist roller 49 can remain earthed. Normally, a DC bias is impressed on the sheet P. However, to charge the sheet P more uniformly, an AC voltage with a DC offset component can be impressed.

The surface of the sheet P that has passed through the resist roller 49, on which a bias is impressed, tends to be slightly negatively charged. As a result, the conditions under which the transfer takes place from the intermediate transfer belt 10 to the sheet P also changes as compared to when no bias is impressed on the resist roller 49.

To realize reliable primary transfer, a primary-transfer contact pressure between the photoconductor 40 and the intermediate transfer belt 10 (hereinafter, "contact pressure") should be maintained within a certain range. However, reliable transfer cannot always be attained with the same contact pressure range, according to the thickness of the intermediate transfer belt and the average roundness of the toner particles.

To circumvent this problem, the inventors of the present invention have formulated expressions in which the contact pressure, the belt thickness, and the average roundness of the toner satisfy the conditions given below.

$$1.5T-40 \leqq P \leqq 1.5T+A \quad (1)$$

$$40 \leqq T \leqq 200 \quad (2)$$

where P is the contact pressure (g/cm$^2$), T is the thickness of the intermediate transfer belt (μm), R is the average toner roundness, and A=2,000R−1,800. As a result, problems such as reduction in transfer efficiency, uneven transfer caused by an insufficient contact pressure, or a hollow defect caused by an excessive contact pressure, can be avoided. Hereinafter, evenness of transfer means the evenness of image density.

Further, if the thickness of the intermediate transfer belt 10 is less than 40 μm, cracks might develop and durability is deteriorated. If the thickness of the intermediate transfer belt 10 exceeds 200 μm, apart from difficulty in realizing reliable primary transfer, the cost increases. Further, increased thickness will increase the rigidity of the intermediate transfer belt 10 and increase the driving torque, resulting in a larger main unit accompanying cost increase. If a Young's modulus of the intermediate transfer belt 10 is less than 2,500 MPa, it is difficult to realize reliable primary transfer, and if the pressure increases, a distorted image is produced. If the Young's Modulus exceeds 5,000 MPa, the durability of the intermediate transfer belt 10 is adversely affected, making it prone to develop cracks.

Further, the primary transfer roller 62 that is relatively soft, having an Ascar C hardness of 20 degrees to 60 degrees, can be used to increase a contact area between the photoconductor 40 and the intermediate transfer belt 10. As a result, even if the transfer pressure or the width of the contact area varies during operation, the contact pressure is not affected. Consequently, more reliable and even transfer can be realized. If the primary transfer roller 62 has an Ascar C hardness of less than 20 degrees, the contact area cannot increase beyond a certain point if the spring pressure is increased beyond a specific value. Consequently, the contact pressure cannot be adjusted, resulting in poor transfer. On the other hand, if the primary transfer roller 62 of an Ascar C hardness of more than 60 degrees is used, a hollow defect will start appearing with passage of time, even if the intermediate transfer belt 10, the contact pressure, and the toner satisfy the expressions (1) and (2). This is because the contact area reduces due to the hardness of the primary transfer roller 62. With the passage of time, this results in a significant change in the contact pressure according to the variation in the contact width.

By limiting the thickness of an elastic layer of the primary transfer roller 62 to between 2 mm to 5 mm, a stable contact pressure can be maintained while the machine is operating. This prevents deterioration in the transfer efficiency, uneven transfer, and a hollow defect. It is more advantageous if both the hardness and the thickness of the elastic layer of the primary transfer roller 62 are controlled. Further, the diameter of the primary transfer roller 62 is limited by limiting the thickness. Thus, the primary transfer roller 62 occupies less space.

However, if the thickness of the elastic layer is less than 2 mm, the bias impressed on the metal core leaks out between the core and the intermediate transfer belt 10, resulting in reduced voltage, which can result in poor image transfer. Further, even when pressure is applied, the primary transfer roller 62 cannot be sufficiently compressed, such that the contact area is small. This leads to unstable contact pressure, deterioration in the transfer efficiency, uneven transfer, and a hollow defect. On the other hand, if the thickness of the elastic layer exceeds 5 mm, the contact area of the photoconductor 40 and the intermediate transfer belt 10 increases significantly, resulting in difficulty in adjusting the contact pressure and poor transfer. Further, as the electric field is active in a wide area around the transfer position, when a bias is impressed on the core, transfer starts before reaching the contact area. As a result, a distorted image is created.

Because each of the photoconductors 40 and the primary transfer rollers 62 operates independently, it is difficult to stably maintain a contact width and a contact pressure. Accordingly, the technology according to the present invention is particularly effective in a tandem-type full color image forming apparatus.

In a first embodiment according to the present invention, the intermediate transfer belt 10 is a polyimide seamless belt and the primary transfer roller 62 is made of foam-type rubber.

The intermediate transfer belt 10 is manufactured by the following method. Carbon black is dispersed in a solution of polyamic acid and the mixture is poured into a metal drum and allowed to bake. The film that forms after the mixture bakes is stripped from the metal drum and subjected to stretching under high temperature to obtain a polyimide film. The polyimide film is cut to obtain the endless intermediate transfer belt 10 made of polyimide resin. The method employed for forming the film is explained next. Carbon black is dispersed in a polymer solution and injected into a cylindrical dye. The dye containing the mixture is subjected to heating at 100° C. to 200° C. and simultaneous spinning. The film is obtained by the centrifugal action. The film, in its semi-hard state, is removed from the die and clad over an iron core. The polyimide reaction is continued and the film is hardened by curing the film at 300° C. to 450° C. The intermediate transfer belt 10 is thus obtained. The characteristics of the intermediate transfer belt 10 can be adjusted by changing the amount of carbon, the baking temperature, and the curing temperature. A Young's modulus of the intermediate transfer belt 10 obtained by the method described above is 4,000 MPa.

The average roundness of the toner particle is measured by a flow-type particle analyzer FPIA-2100, manufactured by Sysmex Corporation. As a specific method of measurement, 1 ml to 5 ml of a surface-active agent, preferably alkyl benezene sulfonate, is added, as a dispersing agent, to 50 ml to 100 ml of 1% NaCl solution prepared with first-class sodium chloride, which is passed through a 45 μm filter to remove impurities. To this solution, 1 mg to 10 mg of a sample for measurement is further added. The suspension in which the sample is dispersed is subjected to a dispersion processing for one minute in an ultrasound disperser, to attain a disperse liquid density of 5,000 particles/μl to 15,000 particles/μl. The diameter of a circle having the same surface area as a two-dimensional image of a toner photographed by a charge coupled device (CCD) camera is taken as a circle-equivalent diameter. Any toner particle that has a circle-equivalent diameter of 0.6 μm or more in is considered a valid size, according to precision of the CCD pixels, and used for calculating an average roundness. The average roundness is calculated by first calculating the roundness of each toner particle, adding the roundness of all the toner particles, and dividing the obtained value by the number of toner particles. The roundness of each toner particle is calculated by dividing the circumference of the circle having the same projected surface area as the toner particle by the circumference of the projected image of the toner particle.

The inventors of this invention studied how transfer performance is affected by the contact pressure between the photoconductor 40 and the intermediate transfer belt 10, the thickness of the intermediate transfer belt 10, and the roundness of the toner particle.

First, they studied effects of the contact pressure and the belt thickness. The toner used was ground toner obtained by grinding method, having an average roundness of 0.92. The materials and the manufacturing method are not limited.

Figures 2, 3:
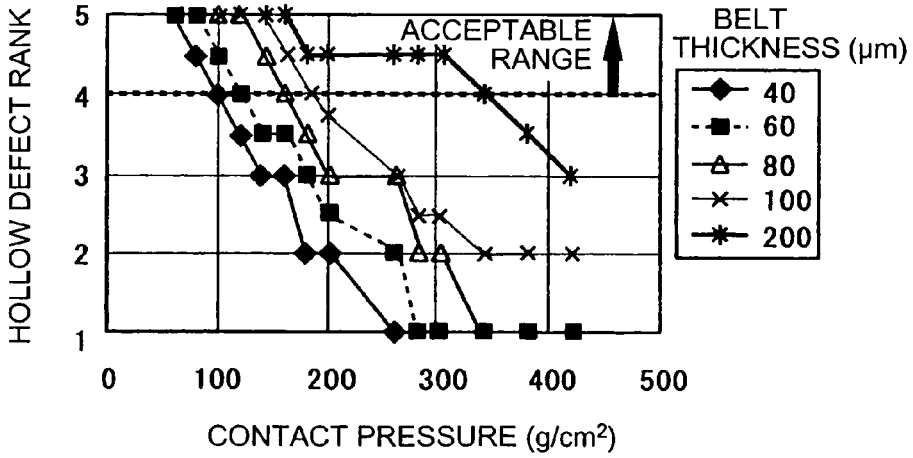
FIG. 2 depicts an effect on evenness of transfer upon varying the thickness of an intermediate transfer belt shown in FIG. 1 and a contact pressure.
FIG. 3 depicts an effect of the thickness of the intermediate transfer belt on a relation between the contact pressure and a hollow defect.

FIG. 2 depicts an effect on evenness of transfer upon varying the thickness of the intermediate transfer belt and the contact pressure. When the contact pressure is weak, the image density becomes uneven. The results are categorized into good (○), acceptable (Δ), and unacceptable (x). The results say that as the belt thickness decreases, even transfer can be attained with reduced contact pressure. In other words, depending on the belt thickness, the lower limit of the contact pressure can be changed for attaining even transfer.

FIG. 3 depicts an effect of the thickness of the intermediate transfer belt on the relation between the contact pressure and a hollow defect. The result is represented by rank 1 through rank 5, rank 1 indicating the most inferior level and rank 5 indicating the most superior level.

Figure 4:
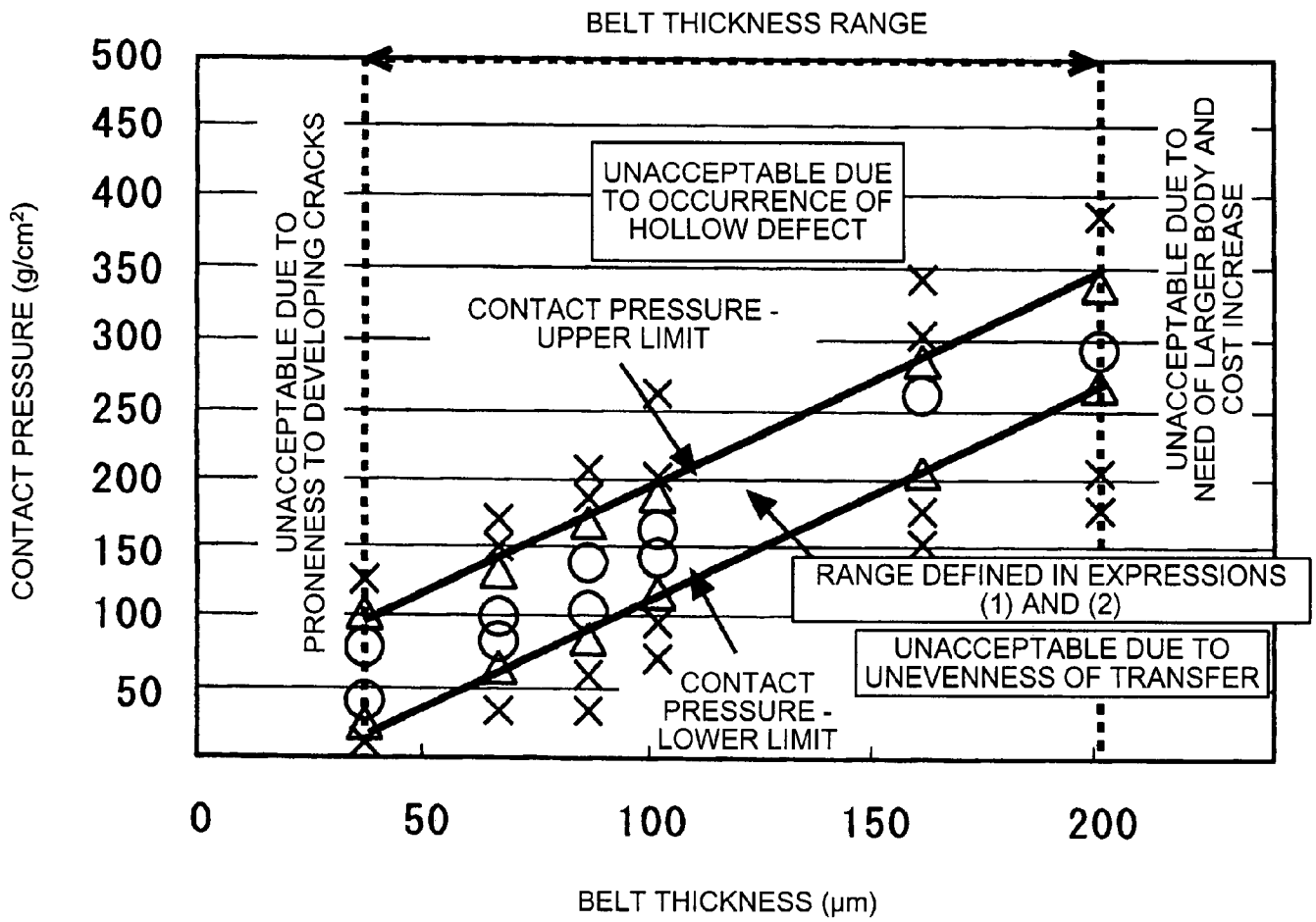
FIG. 4 depicts the effects of the thickness of the intermediate transfer belt and the contact pressure on a hollow defect and even transfer, combining the results shown in FIG. 2 and FIG. 3.

FIG. 4 depicts the effects of the thickness of the intermediate transfer belt 10 and the contact pressure on a hollow defect and even transfer, combining the results shown in FIG. 2 and FIG. 3. In FIG. 4, good (○) indicates even transfer and no hollow defect (corresponding to good (○) in FIG. 2, and "rank 4.5 or higher" in FIG. 3) in FIG. 2, acceptable (Δ) indicates both even transfer and the hollow defect are within acceptable limits (corresponding to acceptable (Δ) in FIG. 2, and "rank 4" in FIG. 3), and unacceptable (x) indicates both evenness of transfer and the hollow defect are outside acceptable limits (corresponding to unacceptable (x) in FIG. 2, and "rank 3.5 or lower" in FIG. 3). The dashed lines in FIG. 4 indicate the range of the belt thickness. The area enclosed within the two dashed lines and two primary lines indicating the upper and lower limits of the contact pressure represent the range defined by the expressions (1) and (2). Beyond this range, either the hollow defect or the evenness of transfer was unacceptable.

Thus, it was demonstrated that in a toner having the roundness of 0.92, both uneven transfer and a hollow defect can be prevented at the same time by setting the contact pressure and the belt thickness such that the conditions in the expressions (1) and (2) are satisfied.

The effect of the roundness of the toner was studied. Toner particles having an average roundness of 0.95 and 0.98 were produced by the polymerization method. The materials and the manufacturing method are not limited.

Figure 5:
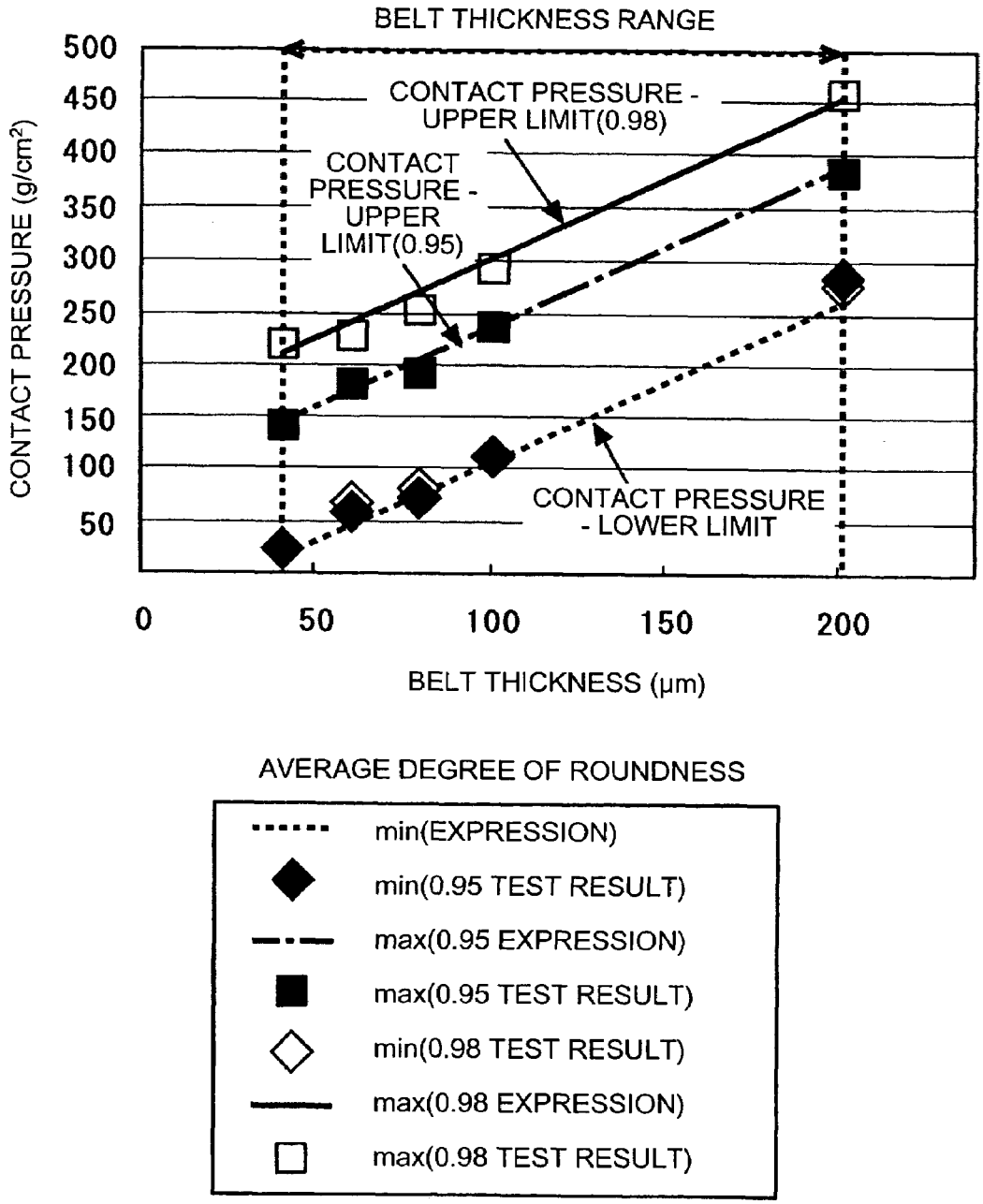
FIG. 5 depicts an effect of roundness of the toner on a relation between the thickness of the intermediate transfer belt and upper and lower limits of the contact pressure.

FIG. 5 depicts an effect of roundness of the toner on a relation between the thickness of the intermediate transfer belt 10 and upper and lower limits of the contact pressure. The relations shown in FIGS. 2 and 3 were studied by using the toner having the average roundness of 0.95, and the toner having the average roundness of 0.98. In FIG. 5, the black squares correspond to the toner having the average roundness of 0.95 and the white squares correspond to the toner having the average roundness of 0.98. The squares indicate maximum or minimum limits in consideration of the hollow defect or the evenness of transfer. Results say that while the lower limit of the contact pressure does not vary according to the average roundness of the toner, the upper limit does vary proportionally to the average roundness. That is, the higher the average roundness, the higher the upper limit.

In FIG. 5, similarly to FIG. 4, the range defined by the solid line and the dashed line representing the upper and lower limits of the contact pressure and the two vertical dashed lines representing the range of the belt thickness, represent the range defined by the expressions (1) and (2). Both of the toners, having the average roundness of 0.95 and 0.98, fall within this range, indicating that the hollow defect and evenness of transfer are within acceptable limits.

Thus, it was demonstrated that both unevenness of transfer and a hollow defect can be prevented at the same time by setting the contact pressure, the belt thickness, and the roundness of the toner such that the conditions in the expressions (1) and (2) are satisfied.

Additionally, if the thickness of the intermediate transfer belt 10 is less than 40 μm, cracks might develop and durability is deteriorated. If the thickness of the intermediate transfer belt 10 exceeds 200 μm, apart from difficulty in realizing reliable primary transfer, the cost increases. Further, increased thickness will increase the rigidity of the intermediate transfer belt 10 and increase the driving torque, resulting in a larger main unit accompanying cost increase. If the Young's modulus of the intermediate transfer belt 10 is less than 2,500 MPa, it is difficult to realize reliable primary transfer, and if the pressure increases, a distorted image is produced. If the Young's Modulus is 5,000 MPa, the durability of the intermediate transfer belt 10 is adversely affected, making it prone to developing cracks.

In a second embodiment, the primary transfer roller 62 is made of foam-type rubber. However, the primary transfer roller 62 can be made of other materials such as NBR, hydrin, polyurathene, etc.

The primary transfer roller 62 is in contact with the photoconductor 40 by springs provided on both sides. The inventors of the present invention studied the relation between the spring pressure and the contact pressure when the hardness of the primary transfer roller 62 was varied.

Figure 6:
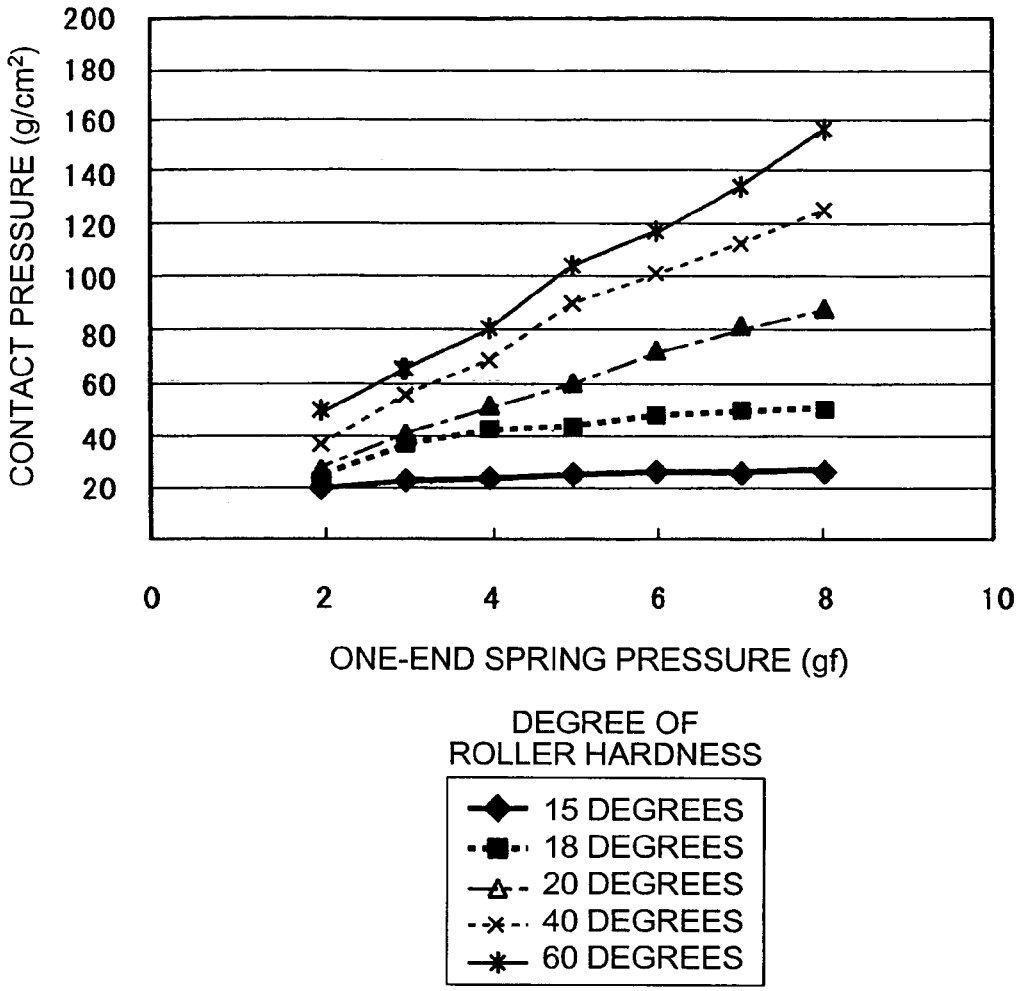
FIG. 6 depicts an effect of hardness of a primary transfer roller shown in FIG. 1 on a relation between a spring pressure and the contact pressure.

FIG. 6 depicts an effect of the hardness of the primary transfer roller 62 on a relation between the spring pressure and the contact pressure. Results say that when the primary transfer roller 62 of an Ascar C hardness of 20 degrees or more is used, increasing the spring pressure increases the contact pressure. When the hardness of the primary transfer roller 62 is reduced, the contact pressure is reduced. This is because the primary transfer roller 62 can be compressed when it is less hard, resulting in a larger contact area. However, when the roller has an Ascar C hardness of less than 20 degrees, the contact area does not increase beyond a specific spring pressure. Consequently, it is difficult to adjust the contact pressure, which leads to poor transfer performance.

Next, the inventors of the present invention studied the relation between the hardness of the primary transfer roller 62 and transfer performance during continuous paper feeding.

Continuous paper feeding was carried out for the primary transfer rollers 62 having hardness levels ranging from 20 degrees to 80 degrees. As a result, a hollow defect occurred to unacceptable degrees in the case of the primary transfer rollers 62 with the hardness of 60 degrees or more, even if the intermediate transfer belt 10, the contact pressure and the toner roundness were set so as to satisfy the expressions (1) and (2). On the contrary, when continuous paper feeding of ten thousand papers was carried out for the primary transfer rollers 62 with the hardness range of 20 degrees to 60 degrees, the hollow defects that occurred were within the acceptable range.

This is because the primary transfer roller 62 with the hardness of 20 degrees to 60 degrees is relatively soft, resulting in an increased contact area. When the contact area is increased, the contact pressure is less affected even if the transfer pressure or the contact width varies while the image forming apparatus is operating. Consequently, the contact pressure is stabilized.

Thus, when the primary transfer roller having an Ascar C hardness of 20 degrees or more and 60 degrees or less, poor transferability, uneven transfer, and a hollow defect can be avoided even if a large quantity of paper is continuously fed.

According to a third embodiment, the primary transfer roller 62 includes a metal core and an elastic layer clad over the metal core. The thickness of the elastic layer is in the range of 2 mm to 5 mm.

If the thickness of the elastic layer is less than 2 mm, a bias impressed on the metal core leaks out between the core and the intermediate transfer belt 10, resulting in reduced voltage. This can result in poor transfer performance. Further, as the primary transfer roller 62 is compressed less when pressure is applied, the contact surface reduces, resulting in unreliability in the contact pressure, accompanying poor and uneven transfer and a hollow defect. On the other hand, if the thickness of the elastic layer exceeds 5 mm, the contact area increases significantly. This makes it difficult to adjust the contact pressure, and results in poor transfer. Further, as the electric field is active in a wide area around the transfer position, when a bias is impressed on the core, transfer starts before the contact area. As a result, a distorted image is created.

By using a primary transfer roller having the specifications described above, poor and uneven transfer, and a hollow defect were prevented even when ten thousand sheets were continuously fed.

According to the present invention, poor transfer performance and uneven transfer caused by insufficient contact pressure, or a hollow defect caused by excessive contact pressure can be prevented.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

at least one image carrier that carries a toner image formed of toner according to image data;

a transfer belt that is stretched over a plurality of rollers and pressed against the image carrier;

at least one primary transfer unit that transfers the toner image from the image carrier to the transfer belt; and a secondary transfer unit that transfers the toner image from the transfer belt to a recording medium, wherein a contact pressure P of the primary transfer unit, a thickness T of the transfer belt, and an average roundness R of the toner satisfy expression 1, and the thickness T of the transfer belt satisfies expression 2, a Young's modulus of the transfer belt being 2,500 MPa or more and 5,000 MPa or less, $$1.5T-40 \leqq P \leqq 1.5T+A \qquad \text{expression 1}$$

$$40 \leqq T \leqq 200 \qquad \text{expression 2}$$

where P is expressed in a unit of g/cm$^2$, T is expressed in a unit of μm, and A=2,000R−1,800.

2. The image forming apparatus according to claim 1, wherein the primary transfer unit includes a primary transfer roller that transfers the toner image from the image carrier to the transfer belt, the primary transfer roller having an Ascar C hardness of 20 degrees or more and 60 degrees or less.

3. The image forming apparatus according to claim 1, wherein the primary transfer unit includes a primary transfer roller that transfers the toner image from the image carrier to the transfer belt, and the primary transfer roller includes a metal core and an elastic layer clad over the metal core, the thickness of the elastic layer being 2 mm or more and 5 mm or less.

4. The image forming apparatus according to claim 1, wherein the image carrier and the primary transfer unit are plural in number, and each toner image on each image carrier is sequentially transferred to the transfer belt by the corresponding primary transfer unit.

* * * * *